US008196319B2

(12) United States Patent
Babolat et al.

(10) Patent No.: US 8,196,319 B2
(45) Date of Patent: Jun. 12, 2012

(54) SHOE, IN PARTICULAR A SPORTS SHOE, COMPRISING A CLAMPING DEVICE

(75) Inventors: Eric Babolat, Lyons (FR); Francis Lepage, Dommartin (FR); Aristide Wolfrom, Lyons (FR)

(73) Assignee: Babolat VS, Lyons (FR)

( * ) Notice: Subject to any disclaimer, the term of this patent is extended or adjusted under 35 U.S.C. 154(b) by 375 days.

(21) Appl. No.: 12/457,211

(22) Filed: Jun. 3, 2009

(65) Prior Publication Data

US 2009/0300947 A1 Dec. 10, 2009

(30) Foreign Application Priority Data

Jun. 3, 2008 (FR) ..... 08 53652

(51) Int. Cl.
*A43B 7/20* (2006.01)
*A43C 11/00* (2006.01)

(52) U.S. Cl. ..... 36/89; 36/105; 36/50.1

(58) Field of Classification Search ..... 36/89, 105, 36/50.1, 50.5

See application file for complete search history.

(56) References Cited

U.S. PATENT DOCUMENTS

| | | | | |
|---|---|---|---|---|
| 3,668,791 | A * | 6/1972 | Salzman et al. | 36/50.1 |
| 4,107,856 | A * | 8/1978 | Bourque | 36/50.1 |
| 4,615,127 | A | 10/1986 | Delery | |
| 4,972,613 | A * | 11/1990 | Loveder | 36/105 |
| 5,497,564 | A * | 3/1996 | Allen et al. | 36/50.1 |
| 7,168,188 | B2 * | 1/2007 | Auger et al. | 36/58.5 |

FOREIGN PATENT DOCUMENTS

| | | |
|---|---|---|
| FR | 2 534 116 A | 4/1984 |
| GB | 2 162 043 | 1/1986 |
| WO | WO 2007/112774 | 10/2007 |

* cited by examiner

*Primary Examiner* — Ted Kavanaugh
(74) *Attorney, Agent, or Firm* — Dowell & Dowell, PC

(57) ABSTRACT

A shoe, in particular a sports shoe, which includes a front body for accommodating phalanxes of a foot, a rear body for accommodating a heel of the foot, an internal lateral body and an external lateral body linking the front body and the rear body, and a sole. The shoe has a clamping device for exerting a pressure essentially laterally on the rear body and a clamping member and pinching members for cooperating with the clamping device and wherein the pinching members are positioned laterally on either side of a median strip of the rear body and whereby the pinching members place force against the median strip by tightening of the clamping device.

18 Claims, 3 Drawing Sheets

SHOE, IN PARTICULAR A SPORTS SHOE, COMPRISING A CLAMPING DEVICE

BACKGROUND OF THE INVENTION

1. Field of the Invention

The present invention relates to a shoe, in particular a sports shoe, comprising a clamping device.

2. Brief Description of the Related Art

A shoe, and more particularly a sports shoe, can be subject to high mechanical stresses. When practising sports, such as tennis, it is important for the shoe to ensure that the ankle is secured during the many lateral displacements demanded by this type of sport. In practice, the ankles are greatly stressed by the weight transfers, following split steps.

A known clamping device comprises a rope passing through the rear part of the shoe so as to go around the ankle and, thus, hug its shape. This clamping rope can be actuated by a disc, placed on the tongue. A part of this type of rope can also serve as a shoelace. The activation of this disc causes the rear part of the shoe to be clamped against the ankle and, more generally, the shoe to be clamped onto the foot of the user.

However, such a clamping device exerts a pressure against the Achilles tendon. This pressure is essentially longitudinal along an axis defined along the shoe. Stresses are then exerted on the Achilles tendon so that the risk of damaging it is substantial.

SUMMARY OF THE INVENTION

The aim of the present invention is to provide a clamping device that exerts a pressure against the Achilles tendon that is very much lower than the pressure exerted by a clamping device of the prior art, while guaranteeing that the ankle is held satisfactorily on the occasion of a lateral stress.

To this end, the subject of the invention is a shoe, in particular a sports shoe, comprising:

- a front body, suitable for accommodating the phalanxes of a foot,
- a rear body, suitable for accommodating a heel of the foot,
- an internal lateral body and an external lateral body linking the front body and the rear body,
- a sole on which are positioned these bodies, the sole defining a longitudinal axis, a clamping device, suitable for holding the foot in the shoe, characterized in that the clamping device is suitable for exerting a pressure essentially laterally on the rear body, according to a transversal axis substantially perpendicular to the longitudinal axis, characterized in that the clamping device comprises a clamping member and pinching means of the rear body, suitable for cooperating with the clamping member, the pinching means comprising two separate pinching members positioned laterally on either side of the longitudinal axis, the two members being separated by a median strip belonging to the rear body, the median strip being both suitable to be positioned against the Achilles tendon and suitable to be pinched by activation of the clamping member.

Thanks to the shoe according to the invention, a transversal pressure is exerted on either side of the ankle. The securing of the ankle is thus assured without excessively stressing the Achilles tendon.

According to other advantageous characteristics of the shoe according to the invention, taken in isolation or in all the technically possible combinations:

- the pinching members are integrally joined to the shoe;

- the median strip comprises two wings forming a V, when seen from above, the two wings being suitable for being brought together, on activation of the clamping member;
- the median strip extends to the sole;
- the pinching members comprise a material of a hardness greater than the hardness of the material of the median strip;
- the median strip comprises a material of a hardness comprised between 60 Shore A and 90 Shore A, and preferably between 75 Shore A and 85 Shore A;
- at least one pinching member is made of material of a hardness comprised between 40 Shore D and 70 Shore D, and preferably between 50 Shore D and 60 Shore D;
- the median strip comprises a flexible textile material, such as elastane or spandex;
- the clamping member comprises a self-gripping strip;
- at least one of the pinching members is provided with a guidance area, able to guide the self-gripping strip, on activation of the clamping member;
- the guidance area is delimited by two projecting retaining bindings, positioned substantially facing one another and suitable for holding the self-gripping strip;
- the guidance area is positioned on an upper area of the pinching member, so that the foot does not separate from the shoe, once the clamping member is activated;
- the length of at least one pinching member is substantially equal to a third of the length of the shoe, defined roughly by the length between the front end of the front body and the rear end of the rear body;
- at least one pinching member is made of material of thermoplastic polyurethane type.

BRIEF DESCRIPTION OF THE DRAWINGS

The invention will be better understood from reading the description that follows, given purely by way of example and given with reference to the drawings in which.

DESCRIPTION OF THE PREFERRED EMBODIMENTS

Figures 1, 2, 3:
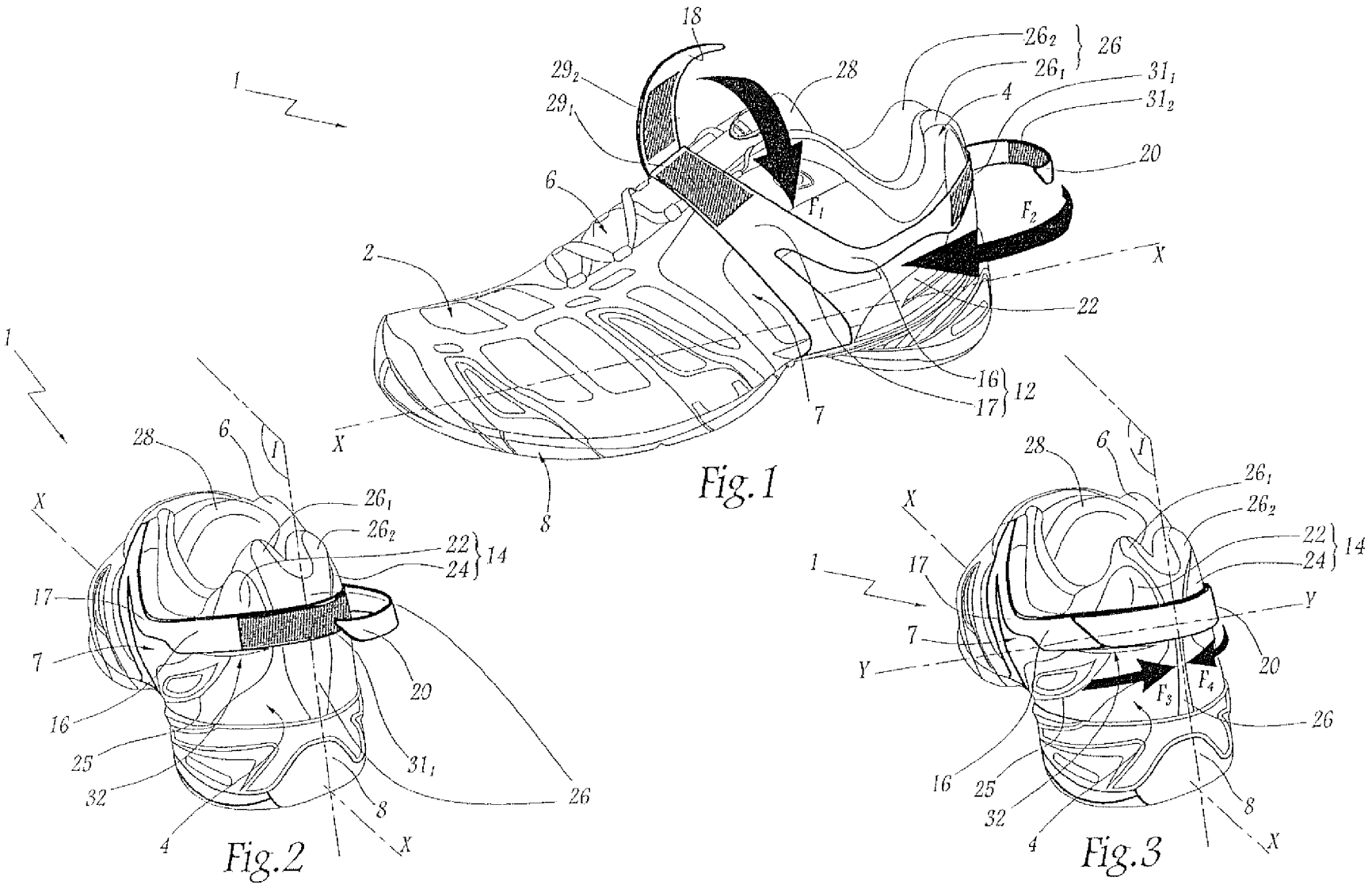
FIG. 1 is a perspective view of a shoe according to the present invention, in a first position.
FIG. 2 is a perspective view of the shoe from another angle, in the first position.
FIG. 3 is a perspective view of the shoe, in a second position.

FIGS. 1 to 3 represent a shoe 1, more particularly a sports shoe and notably a tennis shoe. The shoe 1 comprises a front body 2, a rear body 4, called heel, and an internal lateral body 6 and an external lateral body 7, linking the front body 2 and the rear body 4. The front body 2 is designed to cover the phalanxes of a foot. The rear body 4 covers a heel of the foot.

The front body 2, the rear body 4, the internal lateral body 6 and the external lateral body 7 relate to a shoe 1 worn by the user. The front 2, rear 4 and lateral 6, 7 bodies are jointly positioned on a sole 8, in a known manner. The sole 8 defines a median axis X-X, called longitudinal, namely in the direction of the length of the sole 8.

The shoe 1 comprises a clamping device, formed by a clamping member 12 and pinching means 14, represented in FIGS. 2 and 3. The clamping member 12 is a strip 16, a central part 17 of which is joined to the external lateral body 7 by stitching or by gluing. The strip 16 comprises a first free end 18, suitable for being engaged in a first ring, not represented in FIGS. 1 to 3. The ring is positioned on the internal lateral body 6 on a part that is substantially opposite to the central part 17 in relation to a median plane I passing through the median axis X-X and substantially perpendicular to the plane formed by the sole 8. The strip 16 is provided with a second free end 20 intended to engage in a second ring, not represented in FIGS. 1 to 3 and positioned on the rear body 4. As an example, the two rings can be essentially made of polypropylene. Furthermore, their shape is advantageously oblong, of internal length substantially equal to the width of the strip 16 so as to enable it to engage in both rings.

The pinching means 14 comprise two separate pinching members 22 and 24, positioned on either side of the plane I. At least a portion of the pinching members 22, 24 is fixed to the rear body 4 of the shoe 1, another portion possibly being joined to the corresponding lateral body 7 or 8. The fixing can be provided by gluing or by stitching. The fixing of the pinching members can be integral so that each of the members is joined to the rear body 4 and/or the respective lateral body when this body is deformed. Each pinching member 22, 24 is a shell that can be made of a material of TPU (thermoplastic polyurethane) type.

The rear body 4 of the shoe 1 comprises a median strip 26, represented in FIG. 2. The median strip 26 is positioned between the two pinching members 22, 24 and extends roughly in the plane I to the sole 8. Thus, the pinching of the strip by the pinching members 22, 24 is facilitated. It will be noted that, at least in its upper part, the median strip 26 has a substantially V shape, when seen from above, so that it defines two wings $\mathbf{26}_1$, $\mathbf{26}_2$. As an example, this median strip 26 can comprise a foam or a flexible textile material, such as elastane or spandex.

Advantageously, the pinching members 22, 24 are formed of a material of a hardness far greater than the hardness of the material of the median strip 26. Thus, the pinching members 22, 24 are able to pinch the median strip 26, as will be seen in more detail hereinafter. The shells 22 and 24 are reinforced longitudinally, namely in the direction of the axis X-X. For this, each of the shells 22, 24 respectively comprises a rib 25, 27 extending roughly along the longitudinal axis X-X. Each of the overthicknesses 25, 27 provides a way of favouring a deformation according to an axis substantially parallel to the axis X-X, while limiting any deformation thereof according to an axis perpendicular to the axis X-X in the plane I. This makes it possible to define a longitudinal rigidity of the shells. Furthermore, another function of the pinching members 22, 24 is to give a proper shape to the rear body 4, thus enabling it to hug the heel of the user.

In a first "insertion" position, represented in FIGS. 1 and 2, the clamping device is not activated. In other words, the clamping member 12 exerts no pressure on the pinching means 14. Thus, the foot can be inserted into the shoe 1. The neck of the foot is then in contact with a tongue 28 of the shoe 1 and the heel is covered by the rear body 4 of the shoe 1.

In a second "clamping" position, represented in FIG. 3, the clamping device is activated in order to ensure that the foot is secured by the shoe 1. For this, the free end 18 of the strip 16 is inserted into the first ring. The end 18 is then returned towards the neck of the foot according to the arrow $F_1$. This end 18 is then fixed to the strip 16 using a self-gripping strip $\mathbf{29}_1$, $\mathbf{29}_2$.

The end 20 is also inserted into the second ring. This end 20 is then returned over the rear body 4 according to the arrow $F_2$. The join with the rear body 4 can once again be provided by a self-gripping strip $\mathbf{31}_1$, $\mathbf{31}_2$. The two self-gripping strips are of Velcro type, for example, glued or stitched to the strip 16. It is advantageous to use this type of clamping means since it is progressive and adjustable. It thus adapts easily to the wishes of the user.

Before the free end 20 is inserted into the second ring, the user slides this end over the two pinching members 22, 24. The clamping device is then in activation phase, which will cause the pinching members 22, 24 to be brought together, according to the arrows $F_3$, $F_4$. The direction of displacement can be defined by a transversal axis Y-Y substantially perpendicular to the plane I and therefore to the median axis X-X. The median strip 26 is thus pinched laterally against the Achilles tendon of the foot, which causes the wings $\mathbf{26}_1$, $\mathbf{26}_2$ to be brought towards one another. The clamping device exerts a pressure essentially laterally on the rear body 4. In practice, the pressure is exerted more greatly from the pinching members 22, 24 to the median strip 26 according to the transversal axis Y-Y than from the rear body 4 to the tongue 28 according to the median axis X-X. Since the shells are deformed preferably according to an axis parallel to the axis X-X, the pressure exerted by the clamping device makes it possible to apply a convergence motion on the upper part of the two shells according to the axis Y-Y and thus obtain the clamping of the heel.

Advantageously, the median strip 26 comprises a foam-type material of a hardness of between 60 Shore A and 90 Shore A, and preferably between 75 Shore A and 85 Shore A. Thus, the pinching of the median strip 26 is done without producing folds in the strip itself. In practice, the presence of such folds is uncomfortable to the user. As a variant, the strip can also be made of Lycra.

Figure 4:
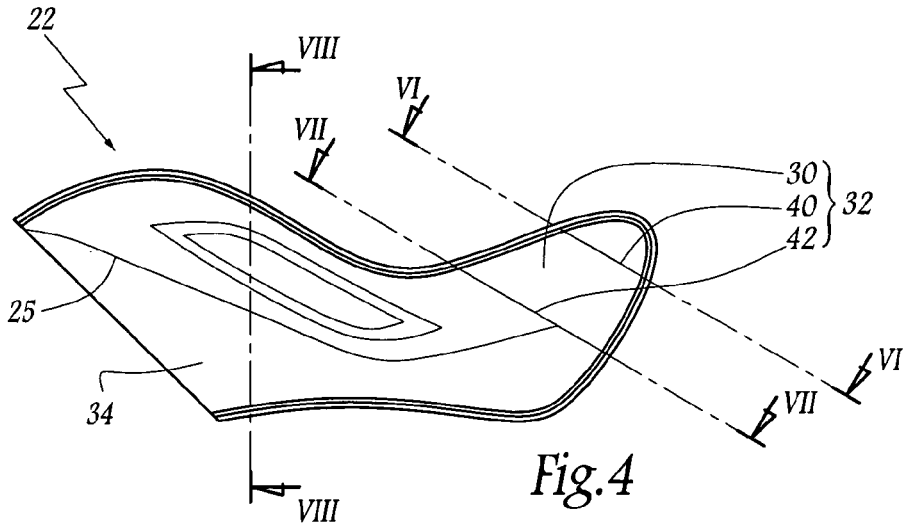
FIG. 4 is a plan view of a first shell, designed to be positioned on an external area of a rear body of the shoe.

FIG. 4 represents an exemplary pinching member 22, intended to be positioned on the external lateral body 7 of the shoe 1. The pinching member 22 comprises a guidance area 32 designed to receive the free end 20 of the strip 16, in order to facilitate the fitting of the free end 20 of the median strip 16 and, in particular, its passage through the second ring. The guidance area 32 is delimited by two bindings, as will be seen hereinbelow.

The member 22 also comprises a fixing area 34 suitable for being fixed under the sole 8. Advantageously, the thickness of this fixing area 34 is less than the thickness of the remainder of the member 22 so that both its insertion under the sole 8 is facilitated and no discomfort is caused between the sole 8 and the body of the shoe 1. Typically, the fixing area 34 has a thickness of between 1 mm and 1.5 mm.

Figure 5:
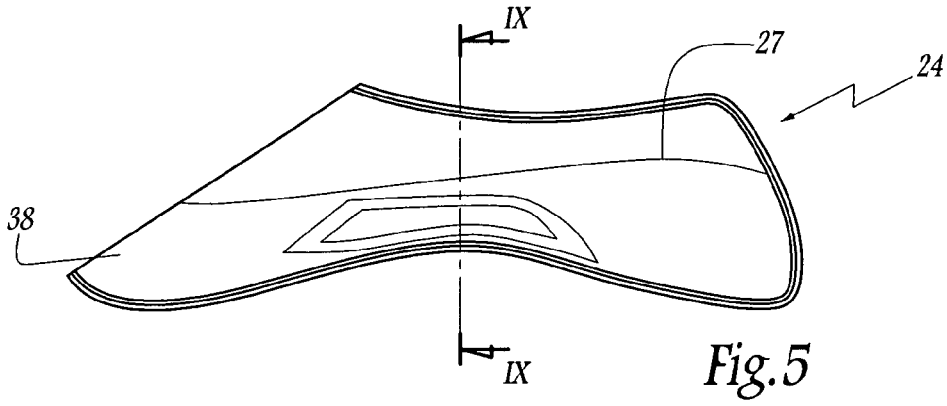
FIG. 5 is a plan view of a second shell, designed to be fixed to an internal area of a rear body of the shoe.

FIG. 5 represents a pinching member 24 suitable for being positioned on the internal lateral body 6 of the shoe 1. This member 24 comprises a fixing area 38 intended to engage under the sole 8. For the same reasons as those stated in the preceding paragraph, the thickness of the fixing area 38 is less than the thickness of the remainder of the member 24.

Advantageously, to provide its function satisfactorily, the pinching member 22, 24 has a length substantially equal to a third of the length of the shoe 1.

Advantageously, the pinching member 22, 24 is made of material of a hardness of between 40 Shore D and 70 Shore D, and preferably between 50 Shore D and 60 Shore D. The pinching member 22, 24 thus has a consistency that is sufficient to enable the median strip 26 to bend.

Figure 6:
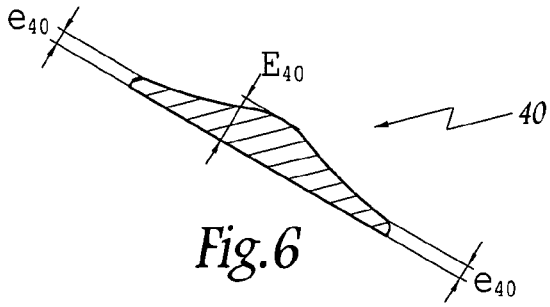
FIG. 6 is a cross-sectional view of a first projecting retaining binding of a guidance means positioned on the shoe according to the plane VI of FIG. 4.
Figure 7:
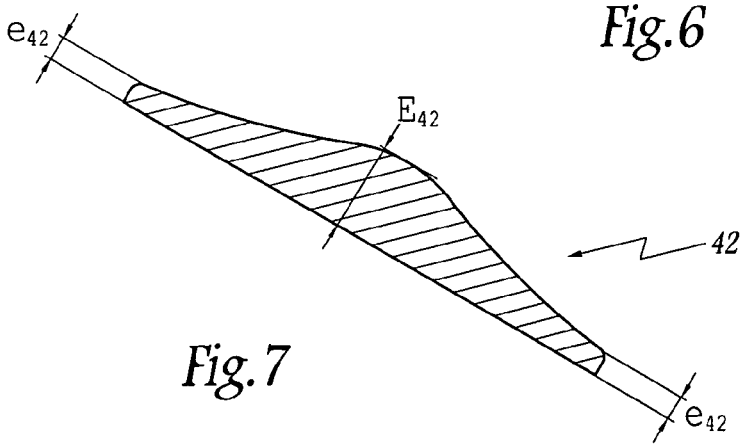
FIG. 7 is a cross-sectional view of a second retaining binding of the guidance means positioned on the shoe according to the plane VII of FIG. 4.
Figure 8:
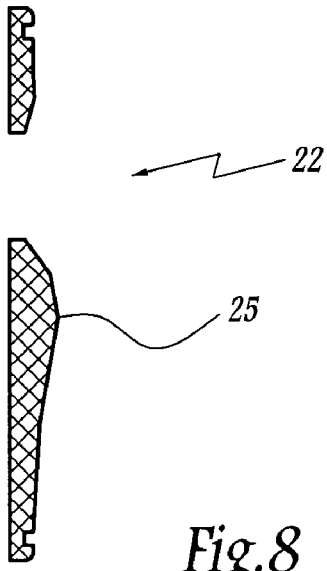
FIG. 8 is a cross-sectional view of the first shell according to the plane VIII of FIG. 4.
Figure 9:
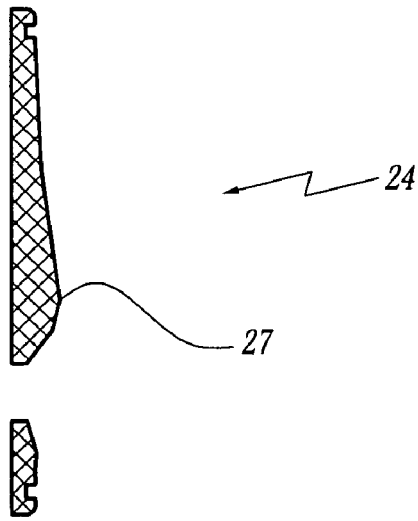
FIG. 9 is a cross-sectional view of the second shell according to the plane IX of FIG. 5.

FIGS. 6 and 7 respectively represent a first projecting retaining binding 40 and a second projecting retaining binding 42 delimiting the guidance area 32. These two bindings are positioned substantially parallel to the pinching member 22.

In order to ensure that the free end 20 of the strip 16 remains in position, the binding 40 has in its median area a thickness $E_{40}$ greater than its thickness $e_{40}$ on the axial ends. The same applies for the binding 42 which, in its median area, has a thickness $E_{42}$ greater than its thickness $e_{42}$ on its axial ends. As an example, the first binding 40 and the second binding 42 respectively have for the first thickness $E_{40}$ 3.50 mm and for the second thickness $E_{42}$ 6 mm, in their median part, and for the thickness $e_{40}$, $e_{42}$ 1.50 mm on both their ends.

It can be noted that each of the bindings 40 and 42 present an overthickness in the extension of the rib 25. Each of the overthicknesses therefore favours the pinching of the rear body 4.

The bindings 40, 42 can be produced, for example, either by thermoforming or by gluing onto the pinching member 22. Advantageously these bindings 40, 42 are positioned on an upper area of the member 22. In practice, such an arrangement provides for a satisfactory clamping, namely a satisfactory securing of the ankle in the shoe 1.

As a variant that is not represented, provision can be made for the use of clamping hooks, of the type of hooks used on ski shoes, instead of the clamping means formed by the strip 16.

It would even be possible to provide a thumbwheel positioned on the tongue 28, the thumbwheel then being able to actuate the clamping of a rope serving as strip and possibly as shoelace. It should be noted that this thumbwheel can be positioned on the pinching members 22, 24.

Moreover, the clamping member 12 can be made of three distinct parts: the central part 17 and two free parts glued or stitched respectively either side of this central part.

Furthermore, provision can be made for the pinching members 22, 24 to be incorporated in the rear body 4 itself. In other words, they can be positioned in the material forming the rear body 4. Two openings can then be provided on the top part facing the outside of the rear body 4. Thus, the projecting retaining bindings 40, 42 can pass through these two openings to allow the self-gripping strip to pass.

The invention claimed is:

1. A shoe comprising:

a front body, suitable for accommodating the phalanxes of a foot, a rear body, suitable for accommodating a heel of the foot, an internal lateral side body and an external lateral side body linking the front body and the rear body, a sole on which are positioned the front, rear, internal lateral side and external lateral side bodies, the sole defining a longitudinal axis, a clamping device, suitable for holding the foot in the shoe, the clamping device is adjustable for exerting a pressure essentially laterally on the rear body, according to a transversal axis substantially perpendicular to the longitudinal axis, and first pinching means positioned on the internal lateral side body and a second pinching means positioned on the external lateral side body, the first and second pinching means being separated and spaced from one another by a median strip forming part of the rear body, the median strip being both suitable to be positioned along a Achilles tendon and suitable to be pinched between the first and second pinching means by adjustment of the clamping device.

2. The shoe according to claim 1, wherein the first and second pinching members are integrally joined to the shoe.

3. The shoe according to claim 2, wherein the median strip extends to the sole.

4. The shoe according to claim 1, wherein the median strip includes two wings forming a V, when viewed from in back of the shoe, the two wings being urged toward one another upon a tightening adjustment of the clamping device.

5. The shoe according to claim 1, wherein the first and second pinching members are formed of a material of a hardness greater than the hardness of a material of the median strip.

6. The shoe according to claim 1, wherein the median strip is formed of a material of a hardness between 60 Shore A.

7. The shoe according to claim 6, wherein the median strip is formed of a material of a hardness between 75 Shore A and 85 Shore A.

8. The shoe according to claim 1, wherein at least one of the first and second pinching member is made of material of a hardness between 40 Shore D and 70 Shore D.

9. The shoe according to claim 8, wherein at least one of the first and second pinching member is made of material of a hardness between 50 Shore D and 60 Shore D.

10. The shoe according to claim 1, wherein the median strip includes a flexible textile material.

11. The shoe according to claim 1, wherein the clamping device includes a self-gripping strip.

12. The shoe according to claim 11, wherein at least one of the first and second pinching members is provided with a guidance area for guiding the self-gripping strip, upon a tightening adjustment of the clamping member.

13. The shoe according to claim 12, wherein the guidance area is delimited by two projecting retaining bindings, positioned substantially facing one another and suitable for holding the self-gripping strip.

14. The shoe according to claim 12, wherein the guidance area is positioned on an upper area of the first pinching member, so that the foot does not separate from the shoe, once the clamping member is tightly adjusted.

15. The Shoe according to claim 1, wherein a length of at least one of the first and second pinching members is substantially equal to a third of a length of the shoe, defined by the length between a front end of the front body and a rear end of the rear body.

16. The shoe according to claim 1, characterized in that wherein at least one of the first and second pinching members is made of a thermoplastic polyurethane material.

17. The shoe according to claim 1, wherein the median strip includes a flexible elastane material.

18. A sports shoe comprising:

a front body, suitable for accommodating the phalanxes of a foot, a rear body, suitable for accommodating a heel of the foot, an internal lateral side body and an external lateral side body linking the front body and the rear body, a sole on which are positioned the front, rear, internal lateral side and external lateral side bodies, the sole defining a longitudinal axis, a clamping device, suitable for holding the foot in the shoe, the clamping device is adjustable for exerting a pressure essentially laterally on the rear body, according to a transversal axis substantially perpendicular to the longitudinal axis, first pinching means positioned on the internal lateral side body and a second pinching means positioned on the external lateral side body, the first and second pinching means being separated and spaced from one another by a median strip forming part of the rear body, the median strip being both suitable to be positioned along a Achilles tendon and suitable to be pinched between the first and second pinching means by adjustment of the clamping device, the median strip including two wings forming a V extending upward at the rear body, when viewed from a back of the shoe, the two wings being urged toward one another upon a tightening adjustment of the clamping device, and the at median strip being formed of a material which is softer than a material forming the first and second pinching members.

* * * * *